US006079336A

United States Patent [19]

Lindstrom

[11] Patent Number: 6,079,336

[45] Date of Patent: Jun. 27, 2000

[54] REMOVABLE CORNER TABLE

[76] Inventor: James Lindstrom, 1595 Trollhagen Dr., Mpls., Minn. 55421

[21] Appl. No.: 09/219,076

[22] Filed: Dec. 22, 1998

[51] Int. Cl.[7] ..... A47B 23/00

[52] U.S. Cl. ..... 108/42

[58] Field of Search ..... 108/153.1, 42, 108/47, 44, 46; 52/262, 263; 248/214, 220.1, 235

[56] References Cited

U.S. PATENT DOCUMENTS

| | | | |
|---|---|---|---|
| D. 362,772 | 10/1995 | Peart . | |
| 814,811 | 3/1906 | Speed . | |
| 1,286,588 | 12/1918 | Goodykoontz | 108/42 X |
| 2,219,975 | 10/1940 | Bentz | 108/42 X |
| 2,261,078 | 10/1941 | Shockey | 108/42 |
| 2,389,349 | 11/1945 | Eastman | 108/42 |
| 2,465,635 | 3/1949 | Conterio | 108/42 |
| 2,966,272 | 12/1960 | MacKenzie . | |
| 3,033,376 | 5/1962 | Eastman | 108/42 |
| 3,389,408 | 6/1968 | Pearson | 108/47 X |
| 4,889,057 | 12/1989 | Chartrand . | |
| 4,986,505 | 1/1991 | Zabawski . | |
| 5,119,742 | 6/1992 | Simmie | 248/214 X |
| 5,469,794 | 11/1995 | Laderoute . | |
| 5,513,575 | 5/1996 | Slade | 108/42 |
| 5,617,797 | 4/1997 | Casey | 108/42 |
| 5,653,178 | 8/1997 | Huczka . | |
| 5,669,313 | 9/1997 | Cottingham . | |

FOREIGN PATENT DOCUMENTS

| | | | |
|---|---|---|---|
| 114319 | 11/1941 | Australia | 248/220.1 |
| 1038577 | 8/1966 | United Kingdom | 108/42 |

*Primary Examiner*—Jose V. Chen
*Attorney, Agent, or Firm*—Beck & Tysver PLLP

[57] ABSTRACT

A removable table spans and rests upon adjoining guard rails on a deck, particularly at a corner of the deck. In use, the table is precluded from sliding out of position by lip members and stop members attached to the table surface.

2 Claims, 4 Drawing Sheets

REMOVABLE CORNER TABLE

FIELD OF THE INVENTION

The present invention relates to furniture for a deck, open porch and balconies. More particularly, this invention relates to a removable table surface for spanning and resting upon two hand-railings on a deck or similar structural arrangement to make use of the corner space formed by adjoining hand-railings to create an out-of-the-way table surface.

BACKGROUND OF THE INVENTION

House decks, open porches, balconies and the like are popular features in home construction. Outdoor grilling and entertaining are typical deck activities. Oftentimes, such activities require or are made easier by the use of a table or other flat surface on which to place cooking utensils, beverage glasses and other paraphernalia. On smaller decks, particularly in townhomes, condominiums and small homes, space is at a premium. Conventional four-legged tables take up valuable interior floor space.

Decks, open porches and balconies are typically circumscribed or delimited by guard or hand railings. In fact, OSHA requires guard railings for all decks. Adjacent guard railings meet or intersect at a corner.

SUMMARY OF THE INVENTION

In light of the above-described qualities of decks, balconies and the like, the present invention provides a removable piece of furniture that provides a table surface without using valuable interior floor space. Still further, the present invention makes use of corner space at the intersection of adjacent guard rails to create an out-of-the-way table surface. The present invention provides a removable table that is secured against sliding out of position in use. The present invention further provides a removable tray that can advantageously be used to carry items from the house to the deck and back.

More specifically, the present invention is a removable or modular table surface that spans and rests upon adjoining guard rails. The table is most conveniently sized and shaped to he placed at the corner of a deck. The table includes structure to prevent the table from sliding out of position. Projections extend from the lower surface of the table and abut the handrails.

In a preferred embodiment, two elongate rims or lip members are connected to the underside of a generally planar table surface. The rims are disposed at an angle that mimics the angle at which the guard railings on which the table will be placed meet one another. In use, the table is placed to span and rest upon adjacent guard railings across the corner of the deck. The table's lip members are positioned to the outside of the guard railings thereby preventing the table from sliding in a direction toward the interior of the deck.

Further, in the preferred embodiment, the table includes an adjustable stop member that is attached to the planar table surface and extends to the rear of the table. When the table is in place on the deck railings, the stop member extends toward the corner formed by the guard rails. To preclude the table from sliding in a direction toward the exterior of the deck, the stop member abuts the intersection of the guard rails.

In the preferred embodiment, the table is removable from the deck and can be used as a tray to carry items to and from the deck.

In alternate embodiments, a variety of structures are incorporated into a removable table to preclude the table from sliding out of position in use.

It is an object of the present invention to provide a table surface that does not consume valuable interior space on a deck. It is a further object of the present invention to make use of the corner space on a deck to provide an out-of-the-way table surface. It is a further object of the invention to provide a removable table so that, as desired, the table can be removed to maximize available deck space. It is a further object of the present invention to provide a table surface that will not slide out of position.

Further objects and advantages of the present invention will be understood by those of skill in the art from the detailed description below in conjunction with the drawings.

BRIEF DESCRIPTION OF THE DRAWINGS

In the drawings, in which like numerals are used throughout to identify corresponding features through several views.

The drawings constitute a part of the specification and illustrate preferred embodiments of the invention. It will be understood that in some instances relative component sizes and material thicknesses may be shown exaggerated to facilitate explanation.

DETAILED DESCRIPTION OF PREFERRED EMBODIMENTS

Figure 1:
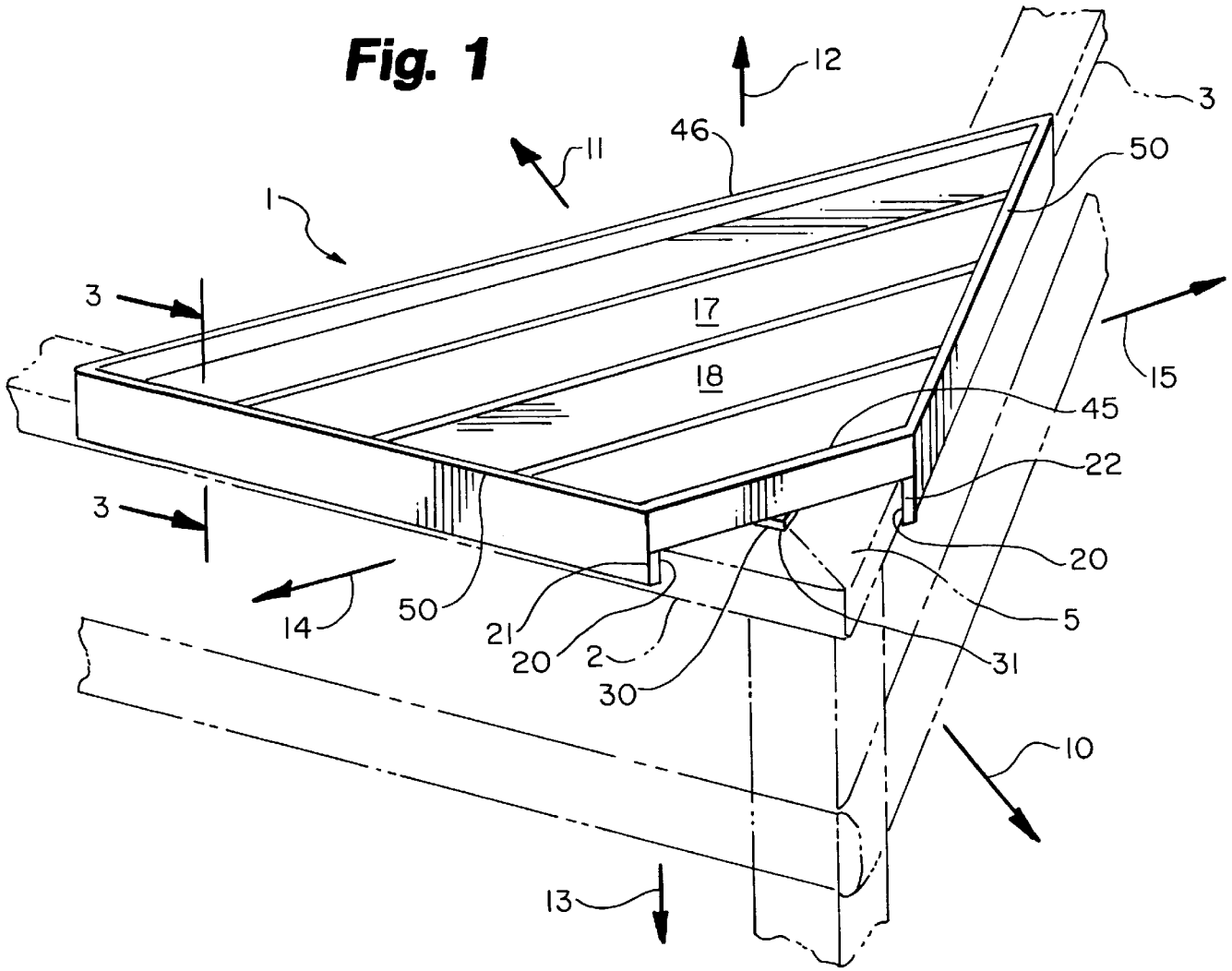
FIG. 1 is a perspective view from the top of a table according to the present invention as positioned in use upon guard railings of a deck illustrated in phantom.

FIG. 1 shows a preferred embodiment of a removable deck table 1. The deck table 1 spans and rests upon adjacent guard or hand railings 2 and 3 of a deck that is illustrated in phantom. The table 1 is preferably sized and constructed to be positioned proximate the corner 5 of the deck.

Throughout this description, the direction "forward" shall mean a direction generally from the interior of the deck toward the exterior of the deck as indicated by arrow 10 in FIG. 1. In opposite, the direction "rearward" or "backward" shall mean a direction generally from the exterior of the deck toward the interior of the deck as indicated by arrow 11 in FIG. 1. The direction "downward" or "downwardly" shall mean a direction generally toward the ground as indicated by arrow 12 in FIG. 1. In opposite, the direction "upward" or "upwardly" shall mean a direction generally toward the sky as indicated by arrow 13 in FIG. 1. Arrows 14 and 15 illustrate lateral "sideways" directions that are generally perpendicular to forward and rearward directions 10 and 11. These directions are used to facilitate explanation of the device, but are not intended to be limiting.

The table 1 has a relatively flat planar member 17 having a top or upper side 18 and bottom or under side 19. Protrusions or projections 20 extend downwardly from the planar member 17. In the preferred embodiment illustrated in FIG. 1, these protrusions 20 are in the form of elongate lip members or ridges 21 and 22. Lip members 21 and 22 are oriented at an angle to one another that matches the angle at which the hand rails on which the table will be placed are disposed to one another. For example, if the hand rails are at 90 degrees to one another, then the lip members 21 and 22 are positioned at 90 degrees to one another. The included angle defined by the hand rails may be acute or obtuse. Similarly, the included angle defined by the lip members may be acute or obtuse.

In use, the lip members 21 and 22 are positioned to the outside or rear of the guard railings 2 and 3. The lip members 21 and 22 abut the guard railings 2 and 3 and prevent or inhibit the table 1 from sliding laterally or horizontally in a rearward direction 11 and otherwise aid in the proper positioning of the table. More specifically, while the lip members 21 and 22 do not inhibit movement of the table in direction 10, they preclude or inhibit movement in direction 11 past the point at which the lip members 21 and 22 each abut a guard railing 2 and 3. Additionally, lip members 21 and 22 inhibit movement of the table in sideways directions 14 and 15. If fact, the lip members 21 and 22 inhibit movement of the table in all directions except direction 10.

Figure 6:
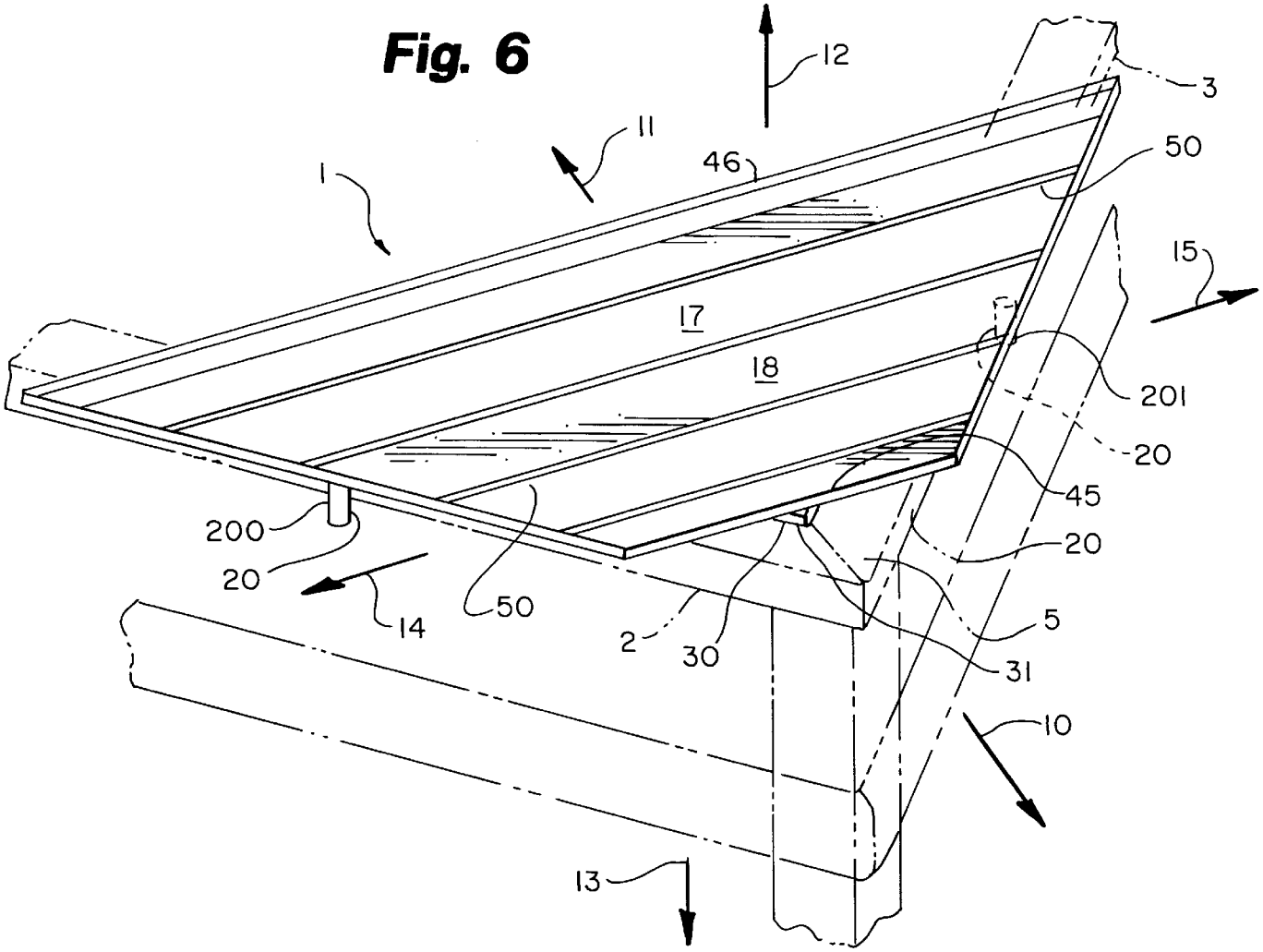
FIG. 6 is a perspective view of an embodiment of a table according to the present invention.

Other configurations for the protrusions 20 are within the spirit of this invention. For example, as illustrated in FIG. 6, spaced-apart posts or pegs 200, 201 generally proximate opposite sides of the table 1 may be used. Functionally, these elements serve to prevent or inhibit the table 1 from sliding laterally or horizontally in a rearward direction 11 and otherwise aid in the proper positioning of the table 1 and therefore are equivalent structures.

Guard railings on decks may differ from deck to deck with respect to their width (in the horizontal direction) and depth (in the vertical direction), in their cross-sectional shape and in various other respects. The lip members 21 and 22 of the table 1 offer the advantage that they will be effective at inhibiting lateral movement in direction 11, and all other directions except direction 10, regardless of these varying characteristics.

Figure 2:
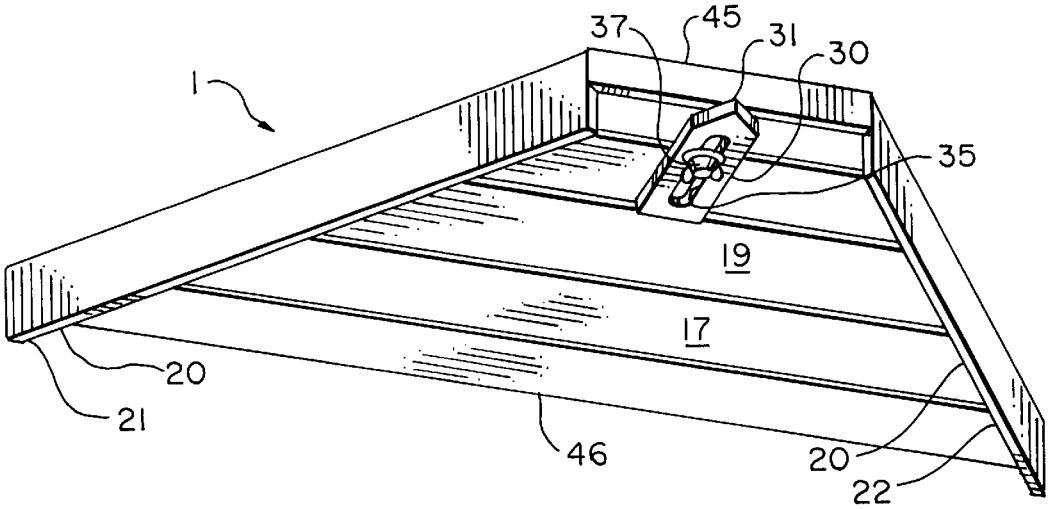
FIG. 2 is a perspective view from the bottom of the table of FIG. 1.
Figure 3:
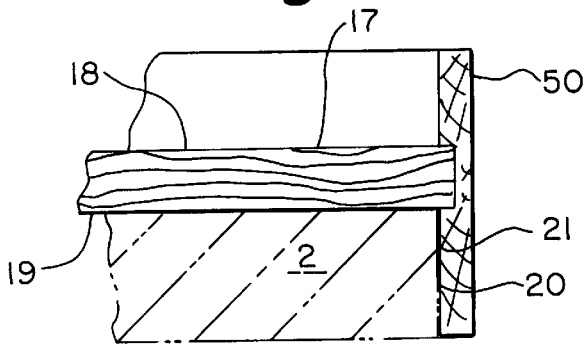
FIG. 3 is a sectional view of a fragment of the table of FIG. 1 taken along line 3—3 in FIG. 1, with portions shown in cross-section.
Figure 4:
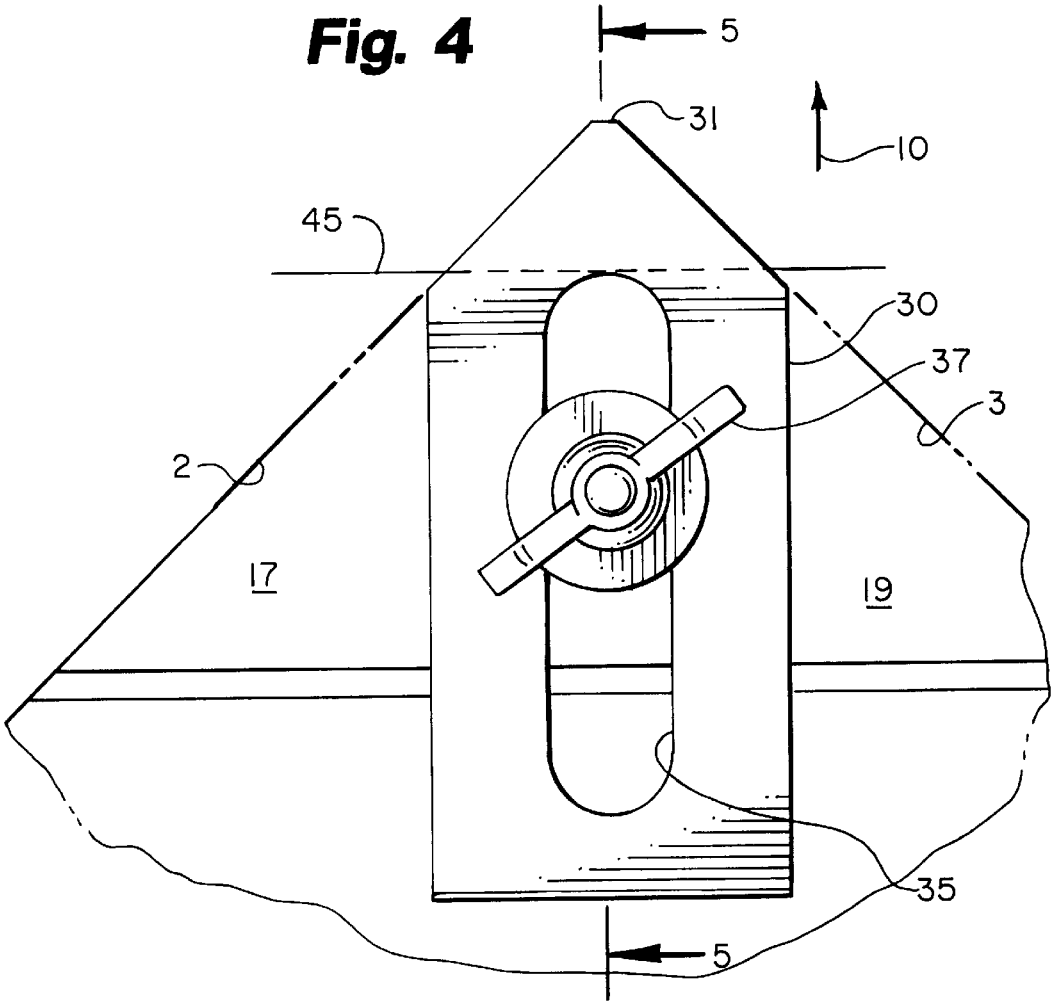
FIG. 4 is an elevated view of a fragment of the bottom of the table of FIG. 1.
Figure 5:
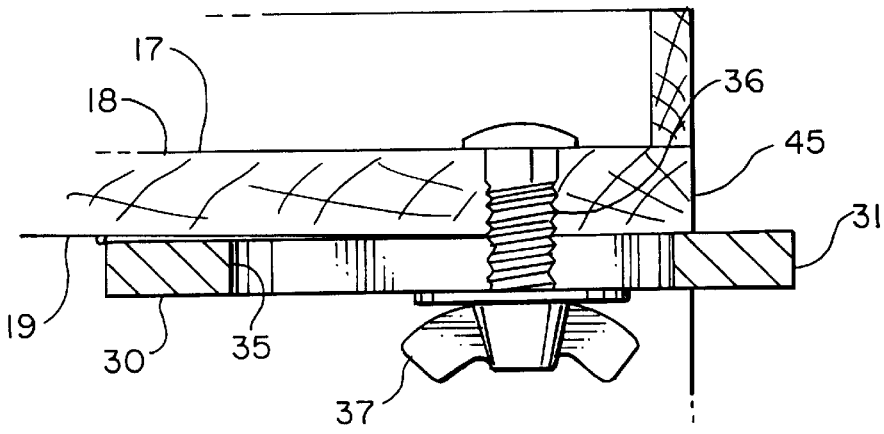
FIG. 5 is a sectional view of a fragment of the table of FIG. 1 taken along line 5—5 in FIG. 4, with portions shown in cross-section.

The preferred embodiment further includes a stop member 30 that inhibits or precludes lateral or horizontal movement of the table 1 in the forward direction 10. The preferred stop member 30 is best viewed from FIGS. 2, 4, and 5. The stop member 30 illustrated is attached to the underside 19 of planar member 17. The preferred stop member 30 terminates at end 31 and the position of this end 31 is adjustable in relation to the lip members 21 and 22. In use, the end 31 of stop member 30 abuts the juncture of guard railings 2 and 3. In this manner, the stop member 30 precludes the table 1 from sliding in a forward direction 10. In some decks the guard railings 2 and 3 each terminate at a corner post or pillar. In such a situation, the stop member end 31 will abut the corner post and thereby perform the same function of inhibiting movement of the table in the forward direction.

In the preferred embodiment illustrated, stop member 30 defines a slot 35 through which a bolt or screw or other connecting hardware 36 extends. A wing nut or other fastener 37 secures the connecting hardware 36. The connecting hardware 36 attaches the stop member 30 to the planar member 17. By loosening the fastener 37, the stop member 30 can slide in directions 10 and 11 with respect to the planar member. In effect, then, the stop member 30 slides with respect to the lip members 21 and 22 also. As a result, the terminating end 31 of the stop member 30 can be selectively adjusted in its position relative to the lip members 21 and 22. This facilitates use of the table 1 with a variety of deck corner constructions.

In alternate embodiments, lip members similar to lip members 21 and 22 may be employed to prevent movement of the table in direction 10, where, in use, the lip members are positioned to the interior of the guard railings.

In use, the user loosens the fastener 37 on stop member 30 and slides stop member 30 to a generally rearward or retracted position. The user then places the table 1 on top of and spanning two guard rails 2 and 3. The user slides the table 1 to the rearwardmost position allowed by lip members 21 and 22. Then, the user slides stop member 30 forward until it abuts the corner of the deck, be it the juncture of the guard rails 2 and 3 or a post. Finally, the user tightens the fastener 37. In this manner, the table 1 is rendered substantially immovable in the forward and rearward directions 10 and 11 thereby securing it against falling onto or off of the deck. As desired, the table 1 can be selectively lifted off of the hand railings 2 and 3 when it is not in use to maximize deck space. Additionally, the table 1 can be used as a tray.

In the embodiment illustrated, the preferred table planar member 17 is generally trapezoidal, with parallel forward and rearward edges 45 and 46 respectively. The side edges are disposed at an angle to one another that matches the angle of the intersection of the guard rails on which the table is to be used. If the guard rails are at 90 degrees to each other, then the side edges of the table are at 90 degrees to each other. The lip members 21 and 22 are proximate the side edges of the table, and extends continuously above the upper surface 18 of the planar member 17 to form an upper skirt or rim 50 to prevent items from falling from the table 1 while in use or when the table 1 is used as a tray.

The trapezoidal shape is advantageous because it leaves no surface hanging over or cantilevered over the guard railings 2 and 3. Nevertheless, other planar member shapes 17 are contemplated, such as square, rectangular, oval, circular and irregular.

To further facilitate the use of the table 1 as a tray, handles, not shown, can be attached to the table 1.

While preferred planar member 17 is generally flat at illustrated, it is contemplated that planar member 17 may have a variety of contours. For example, it may be contoured to define compartments or sections in a fashion similar to a frozen dinner tray or to define cup-holding recessions. As another example, it may be bowl-shaped.

Within the spirit of this invention, a table 1 may be constructed of any material. A table 1 made of wood to match the wood of a deck is of particular aesthetic value and further is sturdy and relatively easily made. A plastic table can be mass-produced cost effectively. A table 1 of relatively lightweight material is particularly desirable to make the table 1 easily maneuverable.

It is to be understood that even though numerous characteristics and advantages of the preferred embodiments of the present invention have been set forth in the foregoing description, tighter with details of the structure and function of the invention, the disclosure is illustrative only, and the present invention may be embodied in a variety of forms within the principles of this invention to the full extent indicated by the broad general meaning of the terms in which the appended claims are expressed. The above descriptions, therefore, are not to be interpreted as limiting, but rather as a basis for the claims and as a basis for teaching persons skilled in the art the invention, which is defined by the appended claims.

I claim:

1. A method of removably attaching a table to a deck, comprising the steps of:

a) providing two non-parallel guard railings oriented at an angle to one another;

b) providing a table having:

i) a generally planar member having top and bottom sides; and ii) two projections extending from the bottom side of said planar member, said projections being disposed at an angle to one another that matches said angle of said guard railings;

iii) a stop member extending forwardly of said planar member forward edge, said stop member being attached to said planar member by a fastener that is adjustable to selectively allow and inhibit movement of said stop member with respect to said planar member;

c) adjusting said fastener to allow movement of said stop member and sliding said stop member rearwardly;

d) placing said table upon said guard railings such that said table spans the guard railings and rests thereupon;

e) positioning said table such that said projections abut said guard railings;

f) sliding said stop member forward until it abuts the juncture of said guard railings; and g) adjusting said fastener to inhibit movement of said stop member to secure said stop member.

2. An apparatus for forming a table at the junction of adjacent railings, comprising:

a) two non-parallel guard railings oriented at an angle to one another; and b) a table resting atop said guard railings having:

i) a generally planar member having top and bottom sides; and ii) two projections extending from the bottom side of said planar member, said projections being disposed at an angle to one another that matches said angle of said guard railings, and said projections abutting said guard railings to prevent rearward movement of said table with respect to said guard railings;

iii) a stop member extending forwardly of said planar member forward edge, said stop member being attached to said planar member by a fastener that is adjustable to selectively allow and inhibit movement of said stop member with respect to said planar member, and said stop member being slidable between a first position spaced from said guard railings and a second position in which said stop member abuts said guard railings inhibiting movement of said table in a forward direction with respect to said guard railings.

* * * * *